US005768394A

United States Patent [19]

Heo

[11] Patent Number: 5,768,394

[45] Date of Patent: Jun. 16, 1998

[54] SURROUND AUDIO SIGNAL REPRODUCING APPARATUS HAVING A SUB-WOOFER SIGNAL MIXING FUNCTION

[75] Inventor: Jae-hoon Heo, Seoul, Rep. of Korea

[73] Assignee: Samsung Electronics Co., Ltd., Kyungki-do, Rep. of Korea

[21] Appl. No.: 699,408

[22] Filed: Aug. 19, 1996

[30] Foreign Application Priority Data

Aug. 18, 1995 [KR] Rep. of Korea ..... 95-21391

[51] Int. Cl.[6] ..... H04R 5/00

[52] U.S. Cl. ..... 381/18; 381/1; 381/17; 381/63; 381/119

[58] Field of Search ..... 381/1, 18, 22, 381/24, 21, 20, 19, 98–99, 119, 17, 27, 63

[56] References Cited

U.S. PATENT DOCUMENTS

| | | | |
|---|---|---|---|
| 4,154,979 | 5/1979 | Barker | 381/99 |
| 5,111,508 | 5/1992 | Gale et al. | 381/100 |
| 5,172,415 | 12/1992 | Fosgate | 381/63 |
| 5,251,260 | 10/1993 | Gates | 381/18 |
| 5,384,855 | 1/1995 | Kwang | 381/86 |
| 5,506,907 | 4/1996 | Ueno | 381/18 |
| 5,546,465 | 8/1996 | Kim | 381/18 |
| 5,621,489 | 4/1997 | Kohut et al. | 352/27 |

*Primary Examiner*—Curtis Kuntz
*Assistant Examiner*—Xu Mei
*Attorney, Agent, or Firm*—Sughrue, Mion, Zinn, Macpeak & Seas, PLLC

[57] ABSTRACT

A surround audio signal reproducing apparatus for reproducing a multi-channel audio signal to generate a surround sound effect is provided. The apparatus contains a surround decoder, a sub-woofer mixing section, a first rear amplifier, and a speaker system having a sub-woofer and a first rear speaker. The surround decoder inputs and decodes the multi-channel audio signal to produce a first rear signal and a sub-woofer signal. The sub-woofer mixing section inputs the sub-woofer signal and the first rear signal and produces a mixed first rear signal. The first rear amplifier inputs and amplifies the mixed first rear signal to produce an amplified first rear signal. Then, the speaker system extracts the sub-woofer signal from the amplified first rear signal and reproduces the sub-woofer signal via the sub-woofer. Furthermore, the speaker system extracts the first rear signal from the amplified first rear signal and reproduces the first rear signal via the first rear speaker. Since the surround audio signal reproducing apparatus mixes the sub-woofer signal with the first rear signal before they are amplified, the apparatus is capable of reproducing high quality bass sound and surround sound effect at a low cost.

21 Claims, 2 Drawing Sheets

SURROUND AUDIO SIGNAL REPRODUCING APPARATUS HAVING A SUB-WOOFER SIGNAL MIXING FUNCTION

RELATED APPLICATION

The present application is based on Korean Application No. 21391/1995 which is incorporated herein by reference for all purposes.

FIELD OF THE INVENTION

The present invention relates to a surround audio signal reproducing apparatus. More particularly, the present invention relates to a surround audio signal reproducing apparatus which mixes a sub-woofer signal with rear channel signals before such signals are supplied to a three dimensional ("3-D") speaker system. Consequently, the invention is capable of producing a high quality bass sound and a surround sound effect at a relatively low cost.

BACKGROUND OF THE INVENTION

A surround audio signal reproducing apparatus may comprise a surround decoder and front and rear speaker to produce a surround sound effect. Specifically, the decoder inputs an audio signal, decodes such audio signal into various front and rear audio components, and supplies such components to their corresponding front and rear speakers. Accordingly, the sound output by all of the speakers creates the three-dimensional ("3-D") surround sound effect. In addition, the surround sound effect can be further improved if a sub-woofer signal having a low-band sound is reproduced by the surround audio signal reproducing apparatus.

In order to reproduce the low-band sound, the surround decoder extracts the sub-woofer signal from the input audio signal and supplies such signal to a specific sub-woofer amplifier. Then, the amplifier amplifies and outputs the signal to a sub-woofer speaker.

On the other hand, if a separate sub-woofer amplifier is not provided for the sub-woofer channel, a passive sub-woofer is incorporated into the front speaker, and the sub-woofer signal is supplied to the front speaker via the same channel on which a front audio component is supplied to the front speaker. As a result, the low-band sound of the sub-woofer signal and intermediate-band sound and high-band sound of the front audio component must be separated by a band separator which is contained in the passive sub-woofer in order to reproduce all of the sounds.

However, each of the above configurations has several disadvantages. For example, if the surround audio signal reproducing apparatus comprises a separate amplifier for amplifying the sub woofer signal, the cost and the complexity of the design of the reproducing apparatus is relatively high. On the other hand, if a passive sub-woofer is incorporated in the front speaker, the sound quality of the audio signals reproduced by the apparatus may be significantly degraded. Specifically, if the load of the low-band sound of the sub-woofer signal is excessive, the sound quality will be degraded due to the fact that signal must pass through the band separator in the passive sub-woofer.

SUMMARY OF THE INVENTION

In order to solve the above problems, one object of the present invention is to provide a surround audio signal reproducing apparatus which is capable of reproducing a high quality low-band sound and surround sound effect at a low cost.

To achieve the above object of the present invention, a surround audio signal reproducing apparatus for reproducing a multi-channel audio signal to generate a surround sound effect is provided. Specifically, the apparatus comprises: a surround decoder which inputs and decodes said multi-channel audio signal to produce a left front signal, a center front signal, a right front signal, left rear signal, a right rear signal, and a sub-woofer signal; a sub-woofer mixing section which inputs said sub-woofer signal, said left rear signal, and said right rear signal, wherein said sub-woofer mixing section mixes said sub-woofer signal with said left rear signal to produce a mixed left rear signal and mixes said sub-woofer signal with said right rear signal to produce a mixed right rear signal; a left rear amplifier which inputs and amplifies said mixed left rear signal to produce an amplified left rear signal; a right rear amplifier which inputs and amplifies said mixed right rear signal to produce an amplified right rear signal; a center front amplifier which inputs and amplifies said center front signal to produce an amplified center front signal; a left front amplifier which inputs and amplifies said left front signal to °produce an amplified left front signal; a right front amplifier which inputs and amplifies said right front signal to produce an amplified right front signal; and a speaker system having a sub-woofer, a left rear speaker, and a right rear speaker, wherein said speaker system extracts said sub-woofer signal from said amplified left rear signal and said amplified right rear signal and reproduces said sub-woofer signal via said sub-woofer, wherein said speaker system extracts said left rear signal from said amplified left rear signal and reproduces said left rear signal via said left rear speaker, and wherein said speaker system extracts said right rear signal from said amplified right rear signal and reproduces said right rear signal via said right rear speaker.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE PREFERRED EMBODIMENT

The following description of the preferred embodiments discloses specific circuit configurations, components, and relative orientations. However, the preferred embodiments are merely examples of the present invention, and thus, the specific components and relatively orientations described below are merely used to more easily describe such embodiments and to provide an overall understanding of the present invention. Accordingly, one skilled in the art will readily recognize that the present invention is not limited to the specific components and orientations described below. Furthermore, the descriptions of various features and structures of the present invention which would be known to one skilled in the art are omitted for the sake of clarity and brevity.

Figure 1:
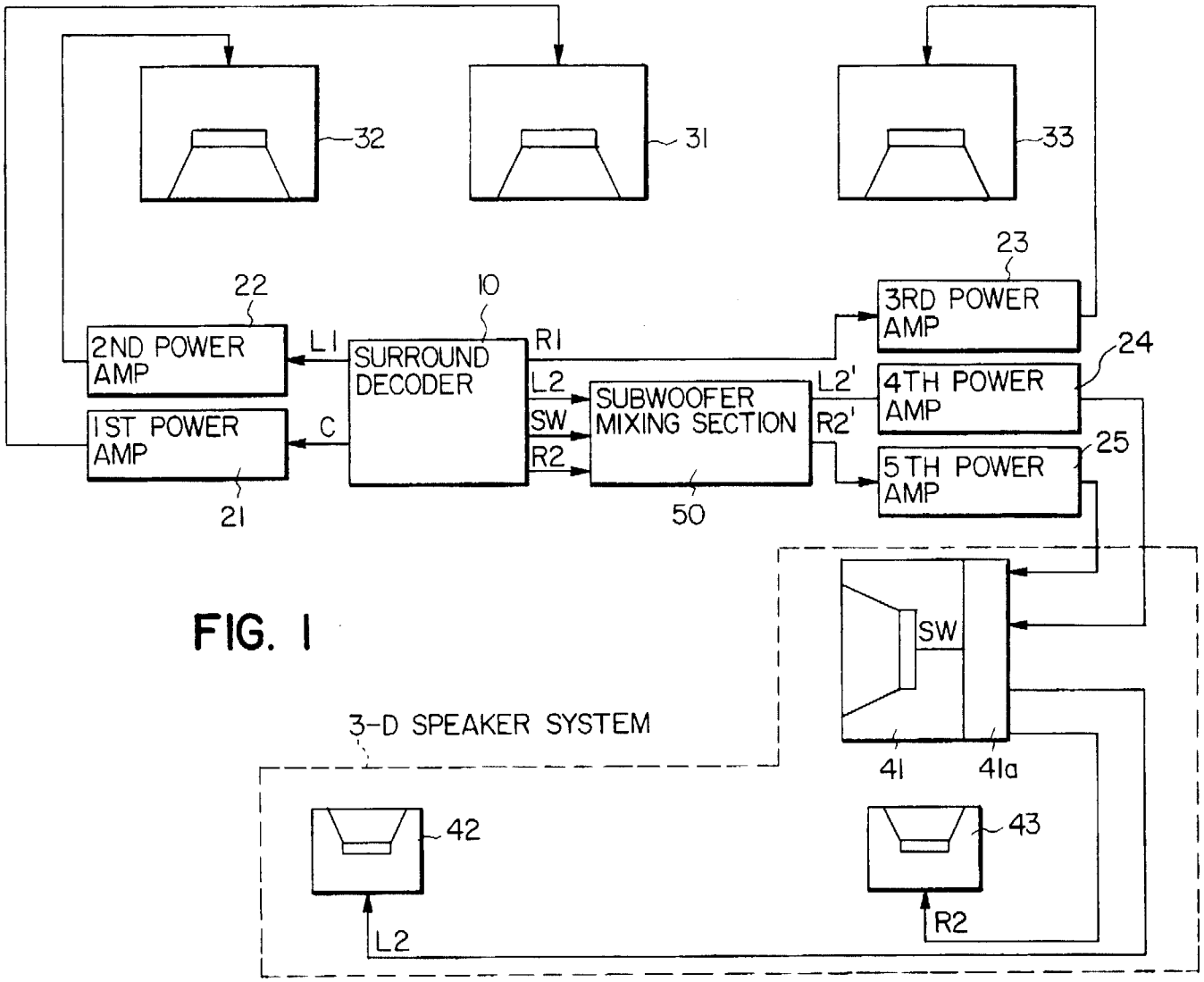
FIG. 1 is a diagram of a surround audio signal reproducing apparatus according to the present invention.

FIG. 1 illustrates an example of a preferred embodiment of a surround audio signal reproducing apparatus according to the present invention. Specifically, the apparatus comprises a surround decoder 10, first through fifth power amplifiers 21 to 25, a center front speaker 31, a left front speaker 32, a right front speaker 33, a sub-woofer mixing section 50, and a three-dimensional ("3-D") speaker system 60.

The surround decoder 10 inputs an audio signal and decodes the audio signal to produce various component signals. For example, the decoder 10 may generate a left front signal L1, a right front signal R1, a center front signal C, a left rear signal L2, a right rear signal R2, and a sub-woofer signal SW.

The front signal amplifiers 21 to 23 amplify the front signals C, L1, and R1 and output amplified signals to the front speakers 31 to 33. In particular, the first power amplifier 21 inputs the signal C, generates a corresponding amplified center front signal, and outputs the amplified signal to the center front speaker 31. The second power amplifier 22 inputs the signal L1, generates a corresponding amplified left front signal, and outputs the amplified signal to the left front speaker 32. Finally, the third power amplifier 23 inputs the signal R1, generates a corresponding amplified right front signal, and outputs the amplified signal to the right front speaker 33.

The sub-woofer mixing section 50 inputs the left rear signal L2 and the sub-woofer signal SW and mixes such signals L2 and SW to produce a mixed left rear signal L2'. Similarly, the mixing section 50 inputs the right rear signal R2 and mixes the sub-woofer signal SW with the signal R2 to generate a mixed right rear signal R2'.

The rear signal amplifiers 24 and 25 amplify the signals L2' and R2' and output the amplified signals to the 3-D speaker system 60. Specifically, the fourth power amplifier 24 inputs the signal L2', generates a corresponding amplified left rear signal, and outputs the amplified signal to the speaker system 60. Similarly, the fifth power amplifier 25 inputs the signal R2', generates a corresponding amplified right rear signal, and outputs the amplified signal to the'speaker system 60.

The 3-D speaker system 60 comprises a sub-woofer 41, a left satellite speaker 42, and a right satellite speaker 43. The sub-woofer 41 comprises a bass sound speaker and a crossover section 41*a*. The crossover section 41*a* inputs the amplified left rear signal and separates such signal into the sub-woofer signal SW and the left rear signal L2. Similarly, the crossover section 41*a* inputs the amplified right rear signal and separates such signal into the sub-woofer signal SW and the right rear signal R2. In particular, since the sub-woofer signal SW is a low-band signal and the signals L2 and R2 are intermediate-band and high-band signals, the crossover section 41*a* can separate the sub-woofer signal SW from the signals L2 and R2 by separating the low-band signal from the intermediate-band and high-band signals. Subsequently, the signal SW is output to the sub-woofer 41, the signal L2 is output to the left satellite speaker 42, and the signal R2 is output to the right satellite speaker 43.

Figure 2:
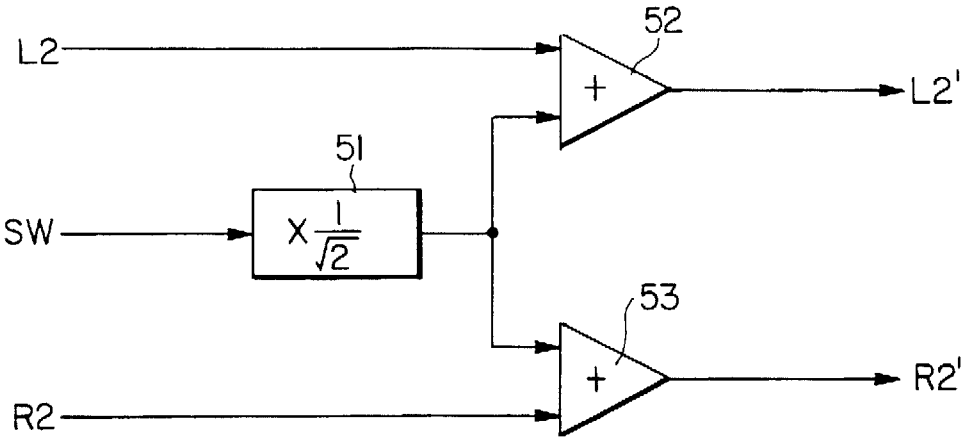
FIG. 2 is a diagram of the sub-woofer mixing section illustrated in FIG. 1.

FIG. 2 shows an illustrative example of the configuration of the sub-woofer mixing section 50. In particular, the mixing section 50 comprises a scaling section 51, a first adder 52, and a second adder 53. The scaling section 51 inputs the sub-woofer signal SW from the surround decoder 10 and scales such signal down by a predetermined factor (e.g. 1+e.fra $\sqrt{2}$+ee ) to produce a scaled signal.

The first adder 52 inputs the scaled signal and the left rear signal L2 and mixes such signals to generate the mixed left rear signal. Similarly, the second adder 53 inputs the scaled signal and the right rear signal R2 and mixes such signals to generate the mixed right rear signal. Then, the mixed left rear signal and the mixed right rear signal are output to the fourth and fifth power amplifiers 24 and 25, respectively.

In addition, the manner in which the sub-woofer mixing section 50 is constructed preferably depends upon the type of audio signal which is input to the surround decoder 10. For example, if the audio signal is a digital signal, mixing section 50 is preferably implemented by a digital circuit or an integrated circuit ("IC") which contains a digital signal processing ("DSP") program. On the other hand, if the audio signal is an analog signal, the mixing section 50 is preferably implemented by an analog circuit comprising one or more operational amplifiers.

As described above, the surround audio signal reproducing apparatus of the present invention mixes the sub-woofer signal SW with the rear channel signals L2 and R2 before supplying the signals SW, L2, and R2 to the 3-D speaker system 50. As a result, the apparatus does not require a separate sub-woofer amplifier or a separate sub-woofer to reproduce the low-band sound (i.e. the bass sound). Consequently, the present invention is able to produce a high quality surround sound effect at a relatively low cost.

The previous description of the preferred embodiments is provided to enable a person skilled in the art to make or use the present invention. Moreover, various modifications to these embodiments will be readily apparent to those skilled in the art, and the generic principles defined herein may be applied to other embodiments without the use of inventive faculty. Therefore, the present invention is not intended to be limited to the embodiments described herein but is to be accorded the widest scope as defined by the claims.

What is claimed is:

1. A surround audio signal reproducing apparatus for reproducing a multi-channel audio signal to generate a surround sound effect, comprising:

a surround decoder which inputs and decodes said multi-channel audio signal to produce a first rear signal and a sub-woofer signal;

a sub-woofer mixing section which inputs said sub-woofer signal and said first rear signal to produce a mixed first rear signal;

a first rear amplifier which inputs and amplifies said mixed first rear signal to produce an amplified first rear signal; and a speaker system having a sub-woofer speaker and a first rear speaker, wherein said speaker system extracts said sub-woofer signal from said amplified first rear signal and reproduces said sub-woofer signal via said sub-woofer speaker, and wherein said speaker system extracts said first rear signal from said amplified first rear signal and reproduces said first rear signal via said first rear speaker.

2. A surround audio signal reproducing apparatus as claimed in claim 1, further comprising:

a second rear amplifier, wherein said surround decoder further decodes said multi-channel audio signal to produce a second rear signal, wherein said sub-woofer mixing section inputs said second rear signal, mixes said second rear signal with said sub-woofer signal, and outputs a corresponding mixed second rear signal, wherein said second rear amplifier inputs and amplifies said mixed second rear signal to produce an amplified second rear signal, wherein said speaker system further has a second rear speaker, wherein said speaker system extracts said sub-woofer signal from said amplified second rear signal and reproduces said sub-woofer signal via said sub-woofer speaker, and wherein said speaker system extracts said second rear signal from said amplified second rear signal and reproduces said second rear signal via said second rear speaker.

3. A surround audio signal reproducing apparatus as claimed in claim 2, wherein said sub-woofer mixing section comprises:

a scaling section which inputs said sub-woofer signal and scales said sub-woofer signal to produce a scaled signal;

a first adder for adding said scaled signal to said first rear signal to produce said mixed first rear signal; and a second adder for adding said scaled signal to said second rear signal to produce said mixed second rear signal.

4. A surround audio signal reproducing apparatus as claimed in claim 3, wherein multi-channel audio signal is a digital signal and said scaling section, said first adder, and said second adder are implemented by a digital circuit.

5. A surround audio signal reproducing apparatus as claimed in claim 3, wherein multi-channel audio signal is a digital signal and said scaling section, said first adder, and said second adder are implemented by an integrated circuit containing a digital signal processing program.

6. A surround audio signal reproducing apparatus as claimed in claim 3, wherein multi-channel audio signal is an analog signal and said scaling section, said first adder, and said second adder are implemented by an analog circuit comprising at least one operational amplifier.

7. A surround audio signal reproducing apparatus as claimed in claim 1, further comprising:

a first front amplifier operatively connected to said surround decoder, wherein said surround decoder further decodes said multi-channel audio signal to produce a first front signal and wherein said first front amplifier inputs and amplifies said first front signal to produce an amplified first front signal; and a first front speaker which is operatively connected to said first front amplifier and which reproduces said amplified first front signal.

8. A surround audio signal reproducing apparatus as claimed in claim 7, further comprising:

a second rear amplifier, wherein said surround decoder further decodes said multi-channel audio signal to produce a second rear signal, wherein said sub-woofer mixing section inputs said second rear signal, mixes said second rear signal with said sub-woofer signal, and outputs a corresponding mixed second rear signal, wherein said second rear amplifier inputs and amplifies said mixed second rear signal to produce an amplified second rear signal, wherein said speaker system further has a second rear speaker, wherein said speaker system extracts said sub-woofer signal from said amplified second rear signal and reproduces said sub-woofer speaker signal via said sub-woofer speaker, and wherein said speaker system extracts said second rear signal from said amplified second rear signal and reproduces said second rear signal via said second rear speaker.

9. A surround audio signal reproducing apparatus as claimed in claim 8, wherein said surround decoder further decodes said multi-channel audio signal to produce a second front signal and a third front signal, and wherein said apparatus further comprises:

a second front amplifier operatively connected to said surround decoder, wherein said second front amplifier inputs and amplifies said second front signal to produce an amplified second front signal;

a third front amplifier operatively connected to said surround decoder, wherein said third front amplifier inputs and amplifies said third front signal to produce an amplified third front signal;

a second front speaker which is operatively connected to said second front amplifier and reproduces said amplified second front signal; and a third front speaker which is operatively connected to said third front amplifier and reproduces said amplified third front signal.

10. A surround audio signal reproducing apparatus as claimed in claim 1, wherein said sub-woofer signal comprises a low-band signal and said sub-woofer speaker reproduces said low-band signal, and wherein said first rear signal comprises at least one of an intermediate-band signal and a high-band signal and said first rear speaker reproduces said at least one of said intermediate-band signal and said high-band signal.

11. A surround audio signal reproducing apparatus as claimed in claim 1, wherein said sub-woofer mixing section comprises:

a scaling section which inputs said sub-woofer signal and scales said sub-woofer signal to produce a scaled signal; and a first adder for adding said scaled signal to said first rear signal to produce said mixed first rear signal.

12. A surround audio signal reproducing apparatus as claimed in claim 11, wherein multi-channel audio signal is a digital signal and said scaling section and said first adder are implemented by a digital circuit.

13. A surround audio signal reproducing apparatus as claimed in claim 11, wherein multi-channel audio signal is a digital signal and said scaling section and said first adder are implemented by an integrated circuit containing a digital signal processing program.

14. A surround audio signal reproducing apparatus as claimed in claim 11, wherein multi-channel audio signal is an analog signal and said scaling section and said first adder are implemented by an analog circuit comprising at least one operational amplifier.

15. A surround audio signal reproducing apparatus as claimed in claim 1, wherein said speaker system comprises a crossover section for extracting said sub-woofer signal from said amplified first rear signal, and extracting said first rear signal from said amplified first rear signal.

16. A surround audio signal reproducing apparatus for reproducing a multi-channel audio signal to generate a surround sound effect, comprising:

a surround decoder which inputs and decodes said multi-channel audio signal to produce a left front signal, a center front signal, a right front signal, left rear signal, a right rear signal, and a sub-woofer signal;

a sub-woofer mixing section which inputs said sub-woofer signal, said left rear signal, and said right rear signal, wherein said sub-woofer mixing section mixes said sub-woofer signal with said left rear signal to produce a mixed left rear signal and mixes said sub-woofer signal with said right rear signal to produce a mixed right rear signal;

a left rear amplifier which inputs and amplifies said mixed left rear signal to produce an amplified left rear signal;

a right rear amplifier which inputs and amplifies said mixed right rear signal to produce an amplified right rear signal;

a center front amplifier which inputs and amplifies said center front signal to produce an amplified center front signal;

a left front amplifier which inputs and amplifies said left front signal to produce an amplified left front signal;

a right front amplifier which inputs and amplifies said right front signal to produce an amplified right front signal; and a speaker system having a sub-woofer speaker, a left rear speaker, and a right rear speaker, wherein said speaker system extracts said sub-woofer signal from said amplified left rear signal and said amplified right rear signal and reproduces said sub-woofer signal via said sub-woofer speaker, wherein said speaker system extracts said left rear signal from said amplified left rear signal and reproduces said left rear signal via said left rear speaker, and wherein said speaker system extracts said right rear signal from said amplified right rear signal and reproduces said right rear signal via said right rear speaker.

17. A surround audio signal reproducing apparatus as claimed in claim 16, wherein said sub-woofer mixing section comprises:

a scaling section which inputs said sub-woofer signal and scales said sub-woofer signal to produce a scaled signal;

a first adder for adding said scaled signal to said left rear signal to produce said mixed left rear signal; and a second adder for adding said scaled signal to said right rear signal to produce said mixed right rear signal.

18. A surround audio signal reproducing apparatus as claimed in claim 17, wherein multi-channel audio signal is a digital signal and said scaling section, said first adder, and said second adder are implemented by a digital circuit.

19. A surround audio signal reproducing apparatus as claimed in claim 17, wherein multi-channel audio signal is a digital signal and said scaling section, said first adder, and said second adder are implemented by a integrated circuit containing a digital signal processing program.

20. A surround audio signal reproducing apparatus as claimed in claim 17, wherein multi-channel audio signal is an analog signal and said scaling section, said first adder, and said second adder are implemented by an analog circuit comprising at least one operational amplifier.

21. A surround audio signal reproducing apparatus as claimed in claim 16, wherein said speaker system comprises a crossover section for extracting said sub-woofer signal from said amplified left rear signal and said amplified right rear signal, extracting said left rear signal from said amplified left rear signal, and extracting said right rear signal from said amplified right rear signal.

* * * * *